US006764641B2

(12) United States Patent
Legoupil

(10) Patent No.: US 6,764,641 B2
(45) Date of Patent: Jul. 20, 2004

(54) PLANT FOR PRODUCING A METAL BAND WITH PROTECTION

(75) Inventor: Jean-Luc Legoupil, Paris (FR)

(73) Assignee: VAI Clecim, Nanterre cedex (FR)

( * ) Notice: Subject to any disclaimer, the term of this patent is extended or adjusted under 35 U.S.C. 154(b) by 99 days.

(21) Appl. No.: 10/005,346

(22) Filed: Dec. 7, 2001

(65) Prior Publication Data

US 2002/0095747 A1 Jul. 25, 2002

(30) Foreign Application Priority Data

Dec. 8, 2000 (FR) ..... 00 16030

(51) Int. Cl.[7] ..... C21D 1/46
(52) U.S. Cl. ..... 266/107; 118/423
(58) Field of Search ..... 266/103, 107; 118/423; 24/21

(56) References Cited

U.S. PATENT DOCUMENTS 2,311,616 A * 2/1943 Gordon et al. ..... 266/107
4,101,345 A * 7/1978 Hunter et al. ..... 427/282
4,436,292 A 3/1984 Pfannschmidt ..... 266/107

FOREIGN PATENT DOCUMENTS

EP 0 072 874 A1 3/1983
EP 0 254 633 A1 1/1988

OTHER PUBLICATIONS

European Patent *Abstract Only*, JP 06 170332 A, Jun. 21, 1994.
European Patent *Abstract Only*, JP 06 280046 A, Oct. 4, 1994.
European Patent *Abstract Only*, JP 02 258961 A, Oct. 19, 1990.
European Patent *Abstract Only*, JP 01 142065 A, Jun. 2, 1989.
European Patent *Abstract Only*, JP 07 126863, May 16, 1995.

* cited by examiner

*Primary Examiner*—Scott Kastler
(74) *Attorney, Agent, or Firm*—Arent Fox PLLC

(57) ABSTRACT

A plant which produces a metal band having a protective coating includes a series of treatment sections positioned one after another in a continuous line. The plant includes two coating sections, respectively, a galvanization section and a painting section, in which the metal band follows a running path having at least a vertical portion with a cooling or drying mechanism. The plant is positionable within a single building having a central tower with two abutting sections in which the coating section is provided and two halls in which are installed, respectively, a supply section and an exit section, each with horizontal accumulators.

28 Claims, 3 Drawing Sheets

PLANT FOR PRODUCING A METAL BAND WITH PROTECTION

The invention relates to a plant for producing a metal band coated with at least one protection layer.

Generally, it is known that metal bands are realised in several successive steps, first of all the preparation of a raw product, by ingot mould casting or continuous casting, forging and hot-rolling of this product for providing a so-called 'hot' band reel and finally, cold rolling. Before cold rolling, the hot reel undergoes, generally, a descaling operation, for example, by etching or sandblasting. Cold rolling is realised, normally, in several successive steps, either into two opposite directions on a reversible train, or over several roll stands operating in tandem. An annealing treatment can also be necessary. On the other hand, cold transformation ends, most often, by a finishing treatment by passing, for example, through a 'skin-pass' mill and a planer, to provide the requested surface quality and mechanical characteristics.

Moreover, for certain applications, the band must be coated with a protection layer which may be a metal coating realised, generally, by galvanisation or, more easily, a plain coating such as paint.

These different treatments are realised in specific pieces of equipment which, normally, operate at different speeds and it is the reason why they had been, previously, realised in separate sections of a factory or even in different factories, whereby the band is wound into a reel to be transported from one section to the next.

For some years, it has been sought to integrate as far as possible several successive treatments in a continuous production line in order to avoid load failures, intermediate storage or reel handling from one section to the next. For example, a modern plant may comprise, in a single line, an etching section, a tandem roll mill, an annealing furnace and a sizing stand.

However, the different sections, for example the annealing, etching and rolling sections, operate at rather different speeds and may be slowed down or even stopped in case of failure or, simply, for maintenance purposes. It is therefore necessary to interpose, between certain sections, accumulators that enable to proceed with the treatment in a section in the case of stoppage or slowing down of the band in a section placed upstream or to accumulate the band at the exit of a handling section in case the production has stopped downstream.

A plant of such type is described, for example, in an article entitled 'Tomorrow's cold factory' published in the Revue de Metallurgie, January 1990.

Until now, such plants, which call for considerable investments, were considered as profitable only for very large productions. They operate therefore at very high speeds and, in order to absorb a stoppage or a slowing down, even for a few minutes, over a treatment section, the accumulators must have a capacity of several hundred meters. Usually, the band forms a number of parallel belts following two-ways paths determined by a set of fixed rolls and a set of mobile rolls placed on a looping-in carriage movable between two positions, respectively a minimum accumulation position and a maximum accumulation position. However, such an accumulator remains very cumbersome and continuous line plants are therefore placed in very large buildings comprising one or several halls fitted with travelling cranes enabling to handle the reels and/or the parts necessary to the maintenance of the various pieces of equipment. Such buildings cover a very large ground surface and are very expensive.

As stated, after cold transformation and finishing treatments, the rolled band must often be coated, at least over one face, with a protection layer, for example a metal galvanisation coating or a paint.

It is known that for galvanisation, the metal band passes first of all through a liquid metal bath that is deposited, at exit, on each face of the band, while forming a metal layer whose thickness is adjusted by a rinsing means. To ensure regularity of the deposit, it is necessary that the band should run vertically when exiting from the bath. The metal deposited is then cooled down to solidification. Generally, the band runs therefore along a path comprising a rising vertical branch extending along a cooling device over sufficient length so that the metal can be solidified sufficiently to pass over a deflector roll and a falling branch along which the band is cooled further.

Such a plant is therefore placed in a building whose height corresponds to the necessary cooling length.

The coating can also be applied as the band is running between paint spraying means or rolls.

However, the customers' requirements are quite varied and, according to the usage foreseen, it may prove necessary to provide for galvanisation or paint or even two superimposed protection layers.

After production, for example, of a number of reels of a galvanised band, the order book may call for the realisation of paint-coated band. To meet such requirements with great flexibility, a production factory, even if it is specialised in a certain type of product, must therefore comprise numerous pieces of equipment enabling to perform the necessary operations, for example, a cold rolling line with, possibly, annealing and etching, a galvanisation line and a paint-coating line.

Most often, these pieces of equipment are placed in separate buildings, whereas the cold rolled reels are directed to either of both coating lines in relation to the order book.

This enables to use pieces of equipment whose production can be suited to the needs, but handling the reels may damage the said reels and calls for intermediate storage steps.

Moreover, such a factory consisting of several buildings, which are used solely in relation to the needs, covers globally an extremely large surface.

Besides, it is sometimes necessary to apply a coat of paint over a metal coating whose surface quality must then be suited to the application of a paint.

It appears therefore that it would be interesting to combine the different treatments in order to meet the customers' requirements easily, but this is difficult in current plants whose operating conditions are rather rigid.

The object of the invention is to remedy these different problems thanks to a multi-purpose plant enabling to regroup, in the same line, the pieces of equipment necessary to coatings of different types. Moreover, the invention enables to use these pieces of equipment, either individually or in combination with other pieces of equipment, for example to provide the necessary surface quality or to produce an additional coating.

The invention therefore relates to a plant for producing a metal band coated with at least one protection layer comprising means for controlling the running of the band, successively, through a series of treatment sections, placed one after the other in a continuous line. According to the invention, the plant comprises at least, in one running direction of the band:

- a supply section,
- a first metal-type coating section with two lateral sides perpendicular to a longitudinal running direction of the band, respectively a first side and a second side, and comprising a means for feeding the band into the said metal coating section, located at a low level of the first lateral side of the said section and ending in a tub liable to be filled with a liquid metal bath, means for guiding the band along a first running path comprising an immersion section penetrating into the tub for depositing metal on the band, a rising section extending along a more or less vertical direction between the exit from the tub and a high level and a falling section extending between the said high level and an exit means from the said first coating section, located at a low level on the second lateral side of the said section, and cooling means arranged at least along the rising section of the said first running path for solidification of the metal deposited on the band, a second application-type coating section, located beside the first section and having two lateral sides perpendicular to the running direction, respectively a first side extending along the second side of the metal coating section and a second side, whereas the said coating section comprises means for coating the band, means that are placed at a low level of the said first side, means for guiding the band along a second running path passing in front of the said coating means and comprising at least one rising section extending vertically between the low level of the said coating means and a high level, means for drying the coating after application, extending at least along the said rising section and an exit means from the application section, placed on the second side thereof, an exit section comprising at least one band accumulator and winding means.

Thanks to the invention, the whole plant can be placed in a single building comprising a central tower with two abutting sections in which are provided both coating sections, respectively metal-type and application-type coating sections, as well as two halls of smaller height that extend on either side of the said central tower and in which are installed, respectively, the supply section and the exit section.

Preferably, both these halls exhibit each a height and a length corresponding at least to the height and to the length of an accumulator with corresponding capacity.

In particular, the exit hall exhibits advantageously a height determined in order to cover an exit accumulator while leaving beneath the said accumulator a space of sufficient height to contain, on the one hand a complementary treatment section of the band extending beneath a rear portion of the accumulator and, on the other hand, at least means for winding the band extending beneath a front portion of the accumulator, whereas the length of the said hall is determined in order to leave, ahead of the accumulator, a space necessary to place a means for turning the band over and, possibly, inspection means.

The second hall in which the supply section is placed exhibits advantageously a height determined in order to cover the whole inlet accumulator and an annealing furnace that are superimposed.

The complementary treatment section that is placed on the path of the band between the exit from the first metal coating section and the inlet into the second application-type coating section, comprises for example a 'skin-pass' mill, located between two tensioners and/or a loaded planer and/or an additional coating device such as a chromating or phosphating device.

According to a particularly advantageous embodiment, enabling to reduce the space requirements of the plant, the inlet means into the second application-type coating section is placed on the second side thereof, opposite to the first coating section and the band then follows, between both coating sections, a bent linking path comprising a first horizontal branch passing, at low level, beneath the second coating section, and on which can be placed a complementary treatment section, and a second horizontal branch returning, at middle level, to an inlet means into the second coating section.

According to another preferential characteristic, the plant comprises means for putting into service, selectively, each treatment section thereby enabling to choose an operating mode suited to the needs among a set of combination possibilities of the said treatment sections, for example a first mode with metal coating only, a second mode with metal coating and complementary treatment, a third mode with complementary treatment and application-type coating, a fourth mode with two combined coatings, respectively metal and application, as well as a complementary treatment comprising at least a 'skin-pass' and a fifth mode with application-type coating only.

In order not to mark the band, at the exit from the painting line, it would be preferable to use a vertical accumulator but the latter should be placed in another tall building.

To remedy this shortcoming, a horizontal accumulator is used comprising, in a known fashion, a plurality of parallel belts travelling back and forth, between which are interposed separating arms spaced apart. However, according to another characteristic of the invention, the rear portion of the accumulator comprised between a middle position of the looping-in carriage and its retracted position for minimum accumulation, is deprived of separating arms, whereas tensioners are placed upstream and downstream the accumulator in order to maintain sufficient load on the band to avoid any contacts between the belts travelling back and forth. In such a case, only the rear portion of the accumulator, without any separating arms, is used in paint mode.

Other advantageous characteristics of the invention will appear using the following description of a particular embodiment, given for exemplification purposes and represented on the appended drawings.

FIGS. 1 and 2 show diagrammatically the various members of a plant according to the invention for the production of a metal band with a protection coating, which comprises, in the running direction of the band, a supply section A represented on FIG. 1, two coating sections B and C and an exit section D represented on FIG. 2.

Figure 1:
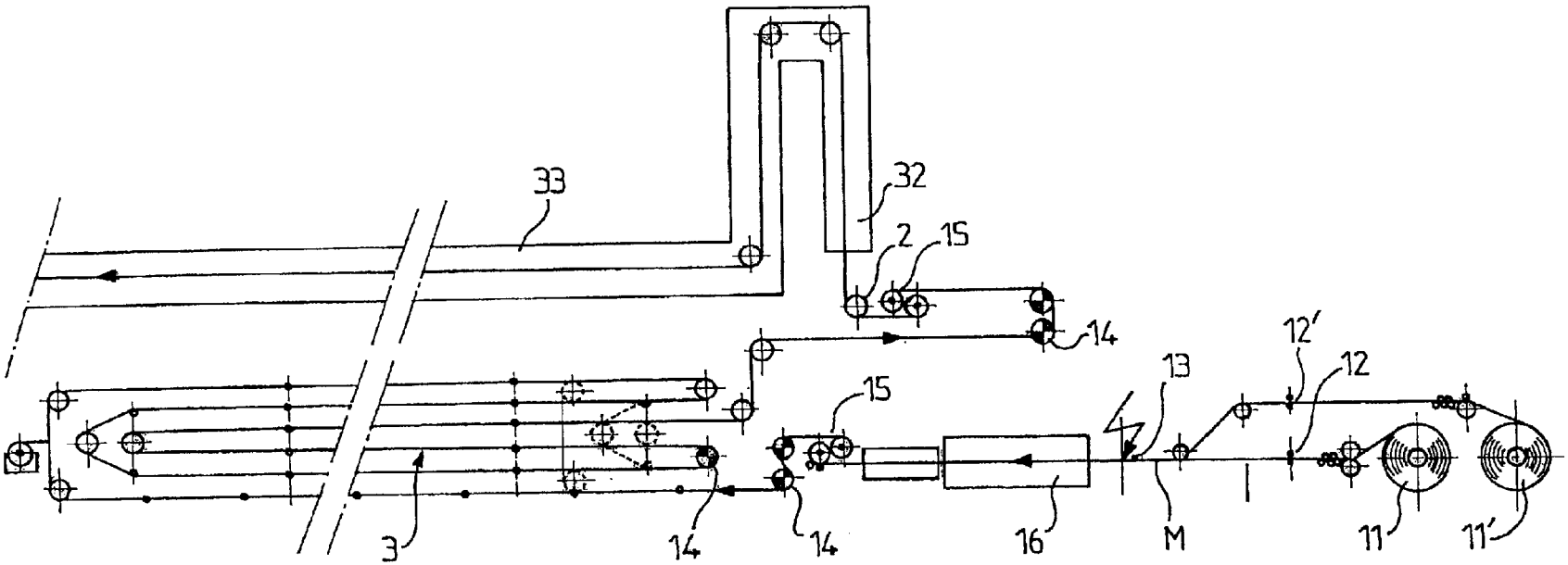
FIG. 1 is a diagrammatical representation of the supply section of a continuous linear plant according to the invention.

The band to be treated is normally in the shape of reels and the supply section A therefore comprises means 1 for unwinding the reels consisting, as usual, of two unwinders 11, 11', two shears 12, 12' and a welding device 13 that enables to link the trailing edge of a reel to the leading edge of the following reel in order to produce a continuous band that runs along a longitudinal direction while following a path determined by a set of deflector rolls 2. Guiding blocks 14 and tensioning devices 15 of a known type are placed at the requested spots on that path to guarantee correct running and drive the band M while controlling the required traction levels in the different section of the plant.

After welding, the continuous tape M thus formed passes through a cleaning-degreasing device 16, then in an accumulator 3 of the horizontal type, whose capacity is intended, in relation to the time necessary to the unwinding of the reels and to the welding, to connect two successive reels without stopping the band from running in the following sections of the plant.

After exit from the accumulator 3, the band reaches a first metal-type coating section B. Normally, this coating is realised by galvanisation in a tub 40 filled with liquid metal inside which is placed an immersed deflector roll 21*b*. The band M from the supply section A is diverted over a roll 21*a* to penetrate into the bath 40 while passing over the immersed roll 21 and exits from the bath along a more or less vertical direction, in order to ensure regular deposit of a metal layer on both its faces. Inside the metal coating section B are placed deflector rolls that delineate a running path 4 of the band comprising at least one vertical rising section 41, a horizontal section 42 placed at high level and a falling section 43.

The rising section 41 is fitted with a quick cooling device 44 extending over a height such that the zinc deposited on both faces of the band is solidified sufficiently, at its exit, to pass without any risks of creating a defect, on an upper roll 22*b*.

The band turns then forward, follows a horizontal path 42 up to a roll 22'*b*, then goes down along the vertical path 43, up to a lower deflector roll 23*b* placed at a lower level of the section. Complementary cooling devices 45, 45' placed along that path enable to complete the cooling of the band M down to the requested temperature.

Preferably, the band then rises to a guiding block 46 for possible re-centring, then goes down again to an exit roll 24*b* placed at the bottom of the section B to follow a horizontal branch 47 passing beneath pieces of equipment of the second application-type coating section C up to a second deflector roll 24'*b*.

The band can then be directed to the second coating section C but, previously, it circulates in a complementary treatment section 5 in which finishing treatments can be performed intended, in particular, to provide the requested surface quality and comprising, for example, a 'skin-pass' mill 51 and a planer under load 52. Tensioning devices 54 enable to determine the requested traction levels in each of these pieces of equipment.

Figure 2:
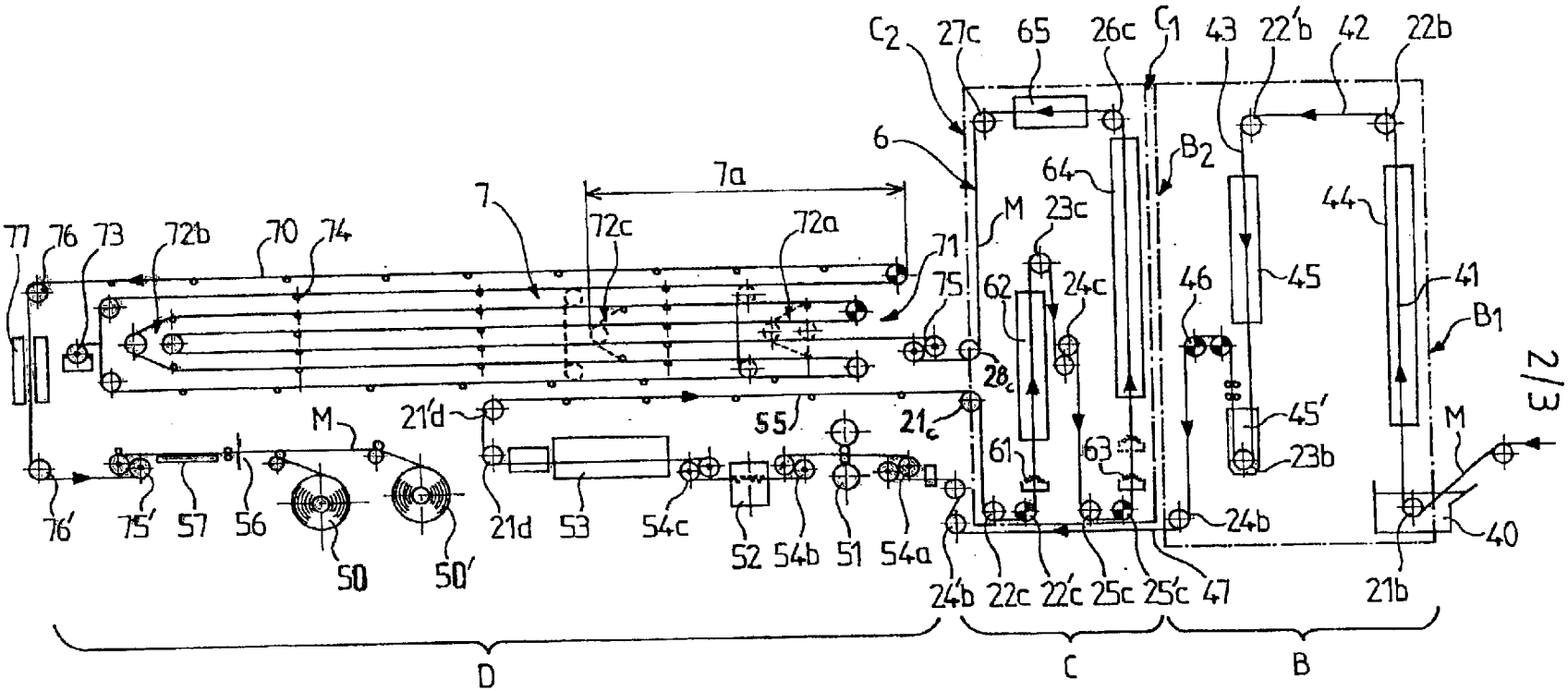
FIG. 2 is a diagrammatical representation of two coating sections and of the exit section of the plant.
Figure 3:
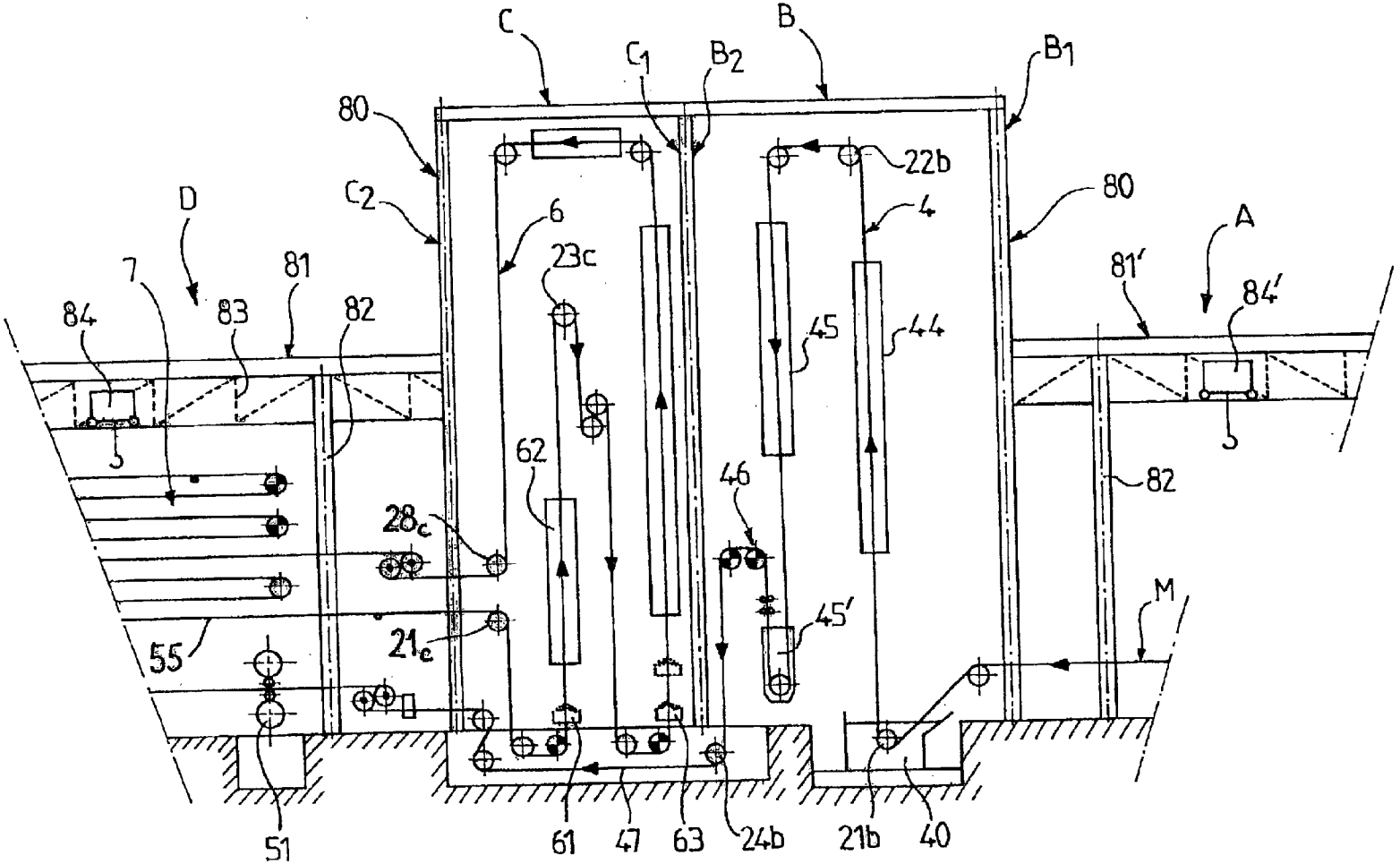
FIG. 3 is a detailed view showing diagrammatically the central section of a building in which the plant is placed.

As shown diagrammatically on FIG. 2, this complementary treatment section 5 is placed, preferably, at the lower level of the plant, in the extension of the horizontal branch 47.

At the exit from this section 5, the band is overturned on a pair of deflector rolls 21*d*, 21'*d* to go back to a middle level toward the second coating section C while passing above the complementary treatment section 5, along a horizontal return branch 55.

This folded configuration of the complementary treatment section 5 enables to adjoin to the said, at its end, an additional piece of coating equipment 53 enabling to realise, for example, a chromating or phosphating operation.

The band then enters the application-type coating section C while passing over a deflector roll 21*c*, then goes down to a lower level defined by a deflector roll 22*c* and a guiding block 22'.

The application coating can be realised, in the second section C, along a running path 6 defined by a set of deflectors and comprising at least a vertical path along which are placed at least one coating device and one quick drying device.

Advantageously, the running path 6 can be folded in order to spread the pieces of equipment into two nested columns.

For example, from the guiding block 22'*c* placed at the lower level of the section C, the band may pass in front of a first coating device 61 to receive a first preparation layer of the surface, that is dried in a vertical furnace 62, for example a gas furnace. Then the band returns to a high roll 23*c* and goes down to a roll 24*c* and a re-centring means 25'*c* placed at the lower level of the section.

Advantageously, a tensioning device 24*c* enables to ensure loaded driving of the band. The said band then passes in front of a second coating device 63 that applies the coat of paint, then goes up into a drying furnace 64 operating, for example, by induction, up to an upper roll 26*c*. Each 62, 64 extends vertically on a height such that the applied coat is dried sufficiently not to be damaged while passing over the deflector roll 23*c*, 26*c*, placed at the exit of the vertical furnace.

The running path 6 then returns forward, via a horizontal branch 65 extending between two rolls 26*c*, 27*c* and on which a cooling device can be placed enabling to lower the temperature of the band down to the requested level.

The band then goes down to an exit deflector roll 28*c* of the second coating section C, which is placed at a middle level, slightly above the inlet roll 21*c*.

The running path 6 in the second section C thus comprises two nested columns enabling to apply on the band two superimposed coats of paint without increasing the space requirements of the section C significantly.

As indicated on FIG. 2, the second application device 63 consists, preferably, of two groups of superimposed rolls that operate alternately in order to limit the stoppage times necessary to the maintenance of these pieces of equipment.

It appears therefore that the band runs in each coating section, respectively metal B and application C, while following a running path comprising at least two vertical branches connected by a horizontal branch. Each coating section B, C is therefore inscribed in a rectangular block having two vertical lateral sides perpendicular to the general horizontal running direction of the band and whose height depends on the time necessary, on the one hand to the solidification of the zinc and, on the other hand, to the drying of the paint, taking into account the running speed. When two coats of paint are necessary, it is possible, as indicated above, to reduce the height of the section while folding the running path into two parallel columns.

If a general running direction of the band is considered, from right to left on the figures, it can be seen that the band M enters at the lower part of the rear lateral side B1 of the galvanisation section B, exits from the lower part of the front side B2, goes beneath the coating section C toward the complementary treatment section 5 and returns backward by the horizontal branch 55 to enter the section C at a middle level of the front lateral side C2 thereof. The band passes then successively through the first coating column 61, 62 inside the section, then in the second column 63, 64 along the rear side C1, passes once more above the first column through the horizontal branch 65, and goes down along the front lateral side C2 to end at a middle level thereof, above the inlet.

Both coating sections B, C are thus arranged in two vertical blocks that are abutting by their lateral sides, respectively front B2 and rear C1. This enables to provide a particularly compact plant.

After leaving the second coating section C, the band M penetrates an exit accumulator 7 of horizontal type comprising, in a known fashion, two sets of looping-in rolls, respectively a fixed assembly placed on the rear, beside the coating section C and close to the exit roll 27*c*, and a mobile assembly 72 placed forward on a carriage not represented that may move horizontally under the action of a control means such as a winch 73. The looping-in rolls 71, 72 thus delineate a jigsaw path of the band comprising a plurality of belts that run respectively forward in the out direction and backward in the return direction.

To do away with the risks of contact between two superimposed belts running in different directions, the accumulator 7 comprises several assemblies of separating arms 74 that are mounted to rotate around vertical axes, on either side of the band and whose engagement and disengagement are controlled by the passage of the looping-in carriage respectively forward and backward.

Thus, from its retracted position 72*a* corresponding to the minimum accumulation length, the carriage 72 moves forward under the action of the control means 73 while passing between the sets of arms 74 that are open. After the passage of the carriage 72 by each set of arms, the said arms close in order to be interposed between the different belts of the band to prevent them from contacting one another. Conversely, each set of separating arms opens just before the passage of the carriage 72 when the said carriage comes backward in order to reduce the accumulated length.

All these arrangements are well known and do not require a more detailed description.

However, as indicated diagrammatically on FIG. 2, it is particularly advantageous, in the case of the invention, that the accumulator 7 does not comprise any separating arms 74 in its first part 7*a*.

Indeed, it is thus possible, when paint coating is performed, to use only that rear part 7*a* of the accumulator deprived of separating arms, in order to avoid the risks of marking the paint. The looping-in carriage 72 moves thus between the retracted position 72*a* and a middle position 72*c* between which the separating arms have been removed.

However, to avoid any contact between two superimposed belts of the band, in that part 7*a* without separating arms, the band M must be held under load by tensioning blocks 75, 75' placed respectively at the inlet and the exit of the accumulator 7.

Obviously, by limiting the length over which the looping-in carriage travels, the capacity of accumulation is reduced but, for the reasons stated further down, the said capacity remains sufficient for paint coating.

As shown on FIG. 2, the complementary treatment section 5 and the return branch 55 of the band to the section C may advantageously be placed beneath a rear portion of the horizontal accumulator 7, which enables to reduce the global space requirements of the plant.

As usual, the metal band M enters the accumulator 7 halfway up the said, follows a jigsaw path while passing successively over the rolls of the looping-in sets 72*a*, 72*b* and exits, at the upper section of the accumulator, through a horizontal belt 70 unwinding forward, i.e. to the left of the figure. The band reaches, then, winding means 50 that are placed, preferably, beneath the front portion of the accumulator 7, whereas the band is overturned on a pair of deflector rolls 76, 76' placed in front of the winch 73.

These winding means 50 comprise, as usual, two winders 55, 55' operating alternately thanks to a junction system and to shears 56 placed upstream as well as, possibly, an oiling device 57.

On the other hand, the downstream tensioning block 75' that is intended for maintaining the band under load in the accumulator is placed advantageously beneath the said accumulator, downstream the lower deflector roll 76'.

Taking into account the global height of the accumulator 7, an inspection device 77 may advantageously be placed on the vertical path of the band, between both deflector rolls 76, 76' for backward overturning.

As can be seen on the diagrams, the arrangement according to the invention enables to provide a particularly compact plant comprising a central portion in which are regrouped both abutting coating sections B, C and two lateral portions, respectively supply A and exit D portions.

It is therefore possible to install all the pieces of equipment of the production line in a single building 8 comprising a central tower 80 with two abutting portions in which are placed both coating sections, respectively metal B and application C sections, and two halls 81', 81 of smaller height extending on either side of this central tower and in which are installed, respectively, the supply section A and the exit section D.

Both these halls 81, 81' resting on posts 82, are each fitted with at least one raceway 83, 83' for travelling cranes 84, 84' enabling to ensure maintenance of the equipment placed in the hall. These raceways 83, 83' converge toward the central tower 80 that may also be fitted with another travelling crane. Advantageously, the frames of the halls 81, 81' and of the central tower 80 are disconnected in order to avoid vibrations in the paint zone that is very sensitive to thereto.

According to another essential characteristic of the invention, each treatment section of the plant is associated with means for putting into service selectively pieces of equipment that can thus either perform the treatment foreseen or simply be run through by the running band without treating the said band. That way, without modifying the constitution of the line, it is possible to choose different operating modes among a set of possibilities, while putting certain pieces of equipment into service, individually or in combination.

For example, if it is requested to realise a galvanisation operation only, the coating systems 61, 62 and 63, 64 are not put into service, whereas the section C is simply run through by the running band.

Conversely, if an application-type coating should be performed only, the galvanisation section B is neutralised, for example while lifting the deflector roll 21*b* above the metal bath. The band follows therefore the running path 4 in the first section B, before penetrating into the complementary treatment section 5.

Similarly, the pieces of equipment of the complementary treatment section 5 can be used, or not, in relation to the characteristics of the sheet and to the requested surface quality.

But both coating sections can also be used simultaneously to apply a coat of paint on the galvanised faces of the band. In such a case, it is possible to fit the skin-pass mill 5 with rolls whose roughness is suited to confer the galvanised faces with a surface quality promoting the adherence of the paint.

Besides, as stated above, overturning the band at its rear portion, at the end of the exit accumulator 7 enables to place an inspection device 77, for example, fitted with mirrors. Such an inspection is particularly useful in the case of a single galvanisation, but it calls for rather frequent stoppages. The exit accumulator 7 will therefore be sized in relation to that use.

Conversely, when the band is painted, the controls may be less frequent and it is the reason why the displacement possibilities of the looping-in carriage 72 can be limited on the rear portion 7*a* of the accumulator 7 deprived of separating arms and whose length may, for example, correspond to approx. one third of the total length of the accumulator 7.

The invention enables therefore to realise a multi-purpose plant, allowing to gather all the necessary pieces of equipment into a continuous line and to use them selectively, according to diverse combinations, in relation to the needs. Thus, it is not necessary any longer to transport the reels from one workshop to another and to realise intermediate storage, whereas all the operations are realised continuously, in a single building.

Obviously, the invention is not limited to the details of the embodiment that has just been described for exemplification purposes, whereas such a plant may comprise more or less a large number of pieces of equipment of all kinds. In particular, if reels ready for galvanisation are available, the supply section A could comprise, simply, an unwinder associated with pre-heating means that enable to bring the band to the requested temperature before it enters the galvanisation bath.

But, it would also be possible to supply the plant with a band provided in another fashion, for example at the exit of a continuous casting plant for realising a rather thin band in order to pass directly through the coating sections, whereas no pre-heating is then necessary.

The reference signs inserted after the technical characteristics mentioned in the claims solely aim at facilitating the understanding thereof and do not limit the extent thereof whatsoever.

What is claimed is:

1. A plant for producing a metal band coated with at least one protection layer comprising means for controlling the running of the band M, successively, through a series of treatment sections, placed one after the other in a continuous line, and comprising at least, in one running direction of the band:

a supply section A, a first metal coating section B with two lateral sides perpendicular to a longitudinal running direction of the band M, respectively a first side B1 and a second side B2, and comprising a means for feeding the band into the metal coating section B, located at a low level of the first side B1 thereof and ending in a tub fillable with a liquid metal bath, means for guiding the band along a first running path comprising an immersion section penetrating into the tub for depositing metal on the band M, a rising section extending along a substantially vertical direction between an exit from the tub and a first high level and a falling section extending between the first high level and a first exit means from the first coating section B, located at a first low level on the second side B2 thereof, cooling means being arranged at least along the rising section of the first running path for solidification of the metal deposited on the band M, a second application coating section C, located beside the first section B and having two sides spaced apart perpendicular to the running direction, respectively a first side C1 extending along the second side B2 of the metal coating section B and a second side C2, wherein the second coating section C comprises second means for coating the band M that are placed at a second low level of the first side C1, means for guiding the band along a second running path passing in front of the second coating means and comprising at least one rising section extending vertically between the low level of the second coating section C and a second high level, along which are placed means for drying the coating after application, and a second exit means from the second coating section C, placed on the second side C2 thereof, and an exit section D receiving the band from the second exit means and comprising at least one band accumulator and winding means.

2. A plant according to claim 1, further comprising a complementary treatment section placed on the path of the band M between the first exit means of the first metal coating section B and an inlet of the second application-coating section C.

3. A plant according to claim 2, characterized in that the complementary treatment section comprises a skin-pass mill placed between two tensioners.

4. A plant according to claim 3, characterized in that the complementary treatment section comprises a planer under load placed between the two tensioners.

5. A plant according to one of the claims 2 to 4, characterized in that the complementary treatment section comprises an additional coating device.

6. A plant according to claim 5, characterized in that the additional coating device includes a chromating device.

7. A plant according to claim 5, characterized in that the additional coating device includes a phosphating device.

8. A plant according to claim 1, further comprising an inlet means for entering the second application coating section C placed on the second side C2 thereof, opposite to the first coating section B and wherein, between the exit means of the first coating section B and the inlet means into the second coating section C, the band follows a bent linking path comprising at least a first horizontal branch passing, at low level, beneath the second coating section C, a means for reversing direction of the linking path, and a second horizontal branch returning, at middle level, to the inlet means into the second coating section C.

9. A plant according to claim 8, characterized in that it comprises a complementary treatment section placed in the extension of the first branch of the linking path and that the second branch returning to the inlet means in the second coating section C passes above the complementary treatment section.

10. A plant according to claim 9, characterized in the exit section D comprises an exit accumulator of horizontal type and that the complementary treatment section and the branch returning to the second coating section C are placed beneath at least one rear portion of the exit accumulator.

11. A plant according to claim 1, characterized in that the second running path in the application coating section C is folded into two nested columns comprising successively, from a low level of the coating section C, a first rising path comprising first coating and drying means, a first means for reversing direction of the second running path, a falling path to a second means for reversing direction of the second running path, a second rising path comprising second coating and drying means, and a return path returning to the front to the second exit means from the application coating section C, placed on the second side C2 thereof, above the inlet means.

12. A plant according to claim 1, characterized in that the exit section D comprises successively, in the running direction of the band M, the at least one band accumulator which comprises an exit accumulator of horizontal type, means for reversing direction of the running path, and the winding means which are placed beneath a front portion of the exit accumulator.

13. A plant according to claim 12, further comprising means for inspecting the band that are placed between the means for reversing direction of the second running path, said means for reversing direction of the second running path including two rolls to the rear of the band and wherein the exit accumulator is sized to enable band stoppages for inspection purposes.

14. A plant according to one of the claims 1, 2, 8, 11, or 12, further comprising means for selectively putting into service pieces of equipment in each treatment section thereby enabling choosing an operating mode suited to the needs among a set of combination possibilities of the pieces of equipment.

15. A plant according to claim 13, characterized in that the means for selectively putting into service pieces of equipment in each treatment section enables choosing an operating mode suited to the needs among a set of possibilities comprising at least a first mode with only metal coating, a second mode with metal coating and complementary treatment, a third mode with complementary treatment and application coating, a fourth mode with both metal coating and application coating, and a fifth mode with only application coating.

16. A plant according to claim 15, wherein each operating mode further comprises a complementary treatment with at least one 'skin-pass' mill.

17. A plant according to claim 1, characterized in that the exit accumulator comprises a plurality of parallel belts traveling back and forth along paths predetermined by a set of fixed rolls and a set of mobile rolls placed on a looping-in carriage movable between two positions which are a minimum accumulation retracted position and a maximum accumulation extended position, and intermediate sets of separating arms spaced apart and distributed over the length of the accumulator in order to come between the parallel belts of the band, wherein each set of separating arms is connected to means for controlling respectively the engagement and the disengagement of the arms, as the looping-in carriage moves respectively in an increasing direction or in a reduction direction of an accumulated length of the band.

18. A plant according to claim 17, characterized in that a rear portion of the exit accumulator, comprised between a middle position of the looping-in carriage and the minimum accumulation retracted position, does not contain any separating arms and in that tensioners are placed, respectively upstream and downstream of the exit accumulator in order to maintain sufficient traction on the band M to prevent any contact between the belts, in said rear portion.

19. A plant according to claim 1, characterized in that the band is brought to a temperature at least equal to that of the liquid metal contained in the tub.

20. A plant according to claim 19, characterized in that the supply section A comprises means for unwinding reels, an inlet accumulator and means for pre-heating the band.

21. A plant according to claim 20, characterized in that the means for pre-heating the band comprises an annealing furnace and means for cooling the band M to a temperature compatible with the metal coating.

22. A plant according to one of the claims 1, 2, 8, 11, 12, or 17, characterized in that said plant further comprises a single building comprising a central tower with two abutting sections in which are provided both the metal coating section B and the application coating section C, and two halls of smaller height than said central tower that extend respectively on either side of said central tower and in which are installed, respectively, the exit section D and the supply section A.

23. A plant according to claim 22, further comprising means for selectively putting into service pieces of equipment in each treatment section thereby enabling choosing an operating mode suited to the needs among a set of combination possibilities of the pieces of equipment.

24. A plant according to claim 23, characterized in that the means for selectively putting into service pieces of equipment in each treatment section enables choosing an operating mode suited to the needs among a set of possibilities comprising at least a first mode with only metal coating, a second mode with metal coating and complementary treatment, a third mode with complementary treatment and application coating, a fourth mode with both metal coating and application coating, and a fifth mode with only application coating.

25. A plant according to claim 22, characterized in that the hall having the exit section D has a height and a length corresponding at least to a height and to a length of the exit accumulator.

26. A plant according to claim 25, characterized in that the hall having the exit section D exhibits a height determined in order to cover the exit accumulator while leaving beneath the accumulator a space of sufficient height to contain a complementary treatment section of the band extending beneath a rear portion of the accumulator, and at least said means for winding the band extending beneath a front portion of the accumulator, wherein the length of the hall is determined in order to leave, ahead of the accumulator, sufficient room to place therein the means for reversing the running direction of the band M.

27. A plant according to claim 25, characterized in that the hall having the supply section A has a height and a length corresponding at least to a height and to a length of an inlet accumulator.

28. A plant according to claim 27, characterized in that the hall having the supply section A exhibits a height determined in order to cover the assembly composed of the inlet accumulator and a means for pre-heating the band.

* * * * *